United States Patent [19]

Matsushita et al.

[11] Patent Number: 4,703,335

[45] Date of Patent: Oct. 27, 1987

[54] HEAT-SENSITIVE AND HEAT-TRANSFERABLE RECORDING SHEET

[75] Inventors: Toshihiko Matsushita, Tokyo; Sadao Morishita, Ibaraki; Mikiya Sekine, Warabi, all of Japan

[73] Assignee: Mitsubishi Paper Mills, Ltd., Tokyo, Japan

[21] Appl. No.: 820,305

[22] Filed: Jan. 21, 1986

[30] Foreign Application Priority Data

Jan. 21, 1985 [JP] Japan ..... 60-9695
Jun. 27, 1985 [JP] Japan ..... 60-98901

[51] Int. Cl.[4] ..... B41M 5/18

[52] U.S. Cl. ..... 503/204; 503/205; 503/206; 503/208; 503/214; 503/226; 427/150; 427/152

[58] Field of Search ..... 503/204, 205, 206, 226, 503/208, 214; 427/150–152

[56] References Cited

U.S. PATENT DOCUMENTS 3,916,068 10/1975 Kohmura et al. ..... 346/205
4,007,310 2/1977 Miyamoto et al. ..... 346/205

FOREIGN PATENT DOCUMENTS 0107884 7/1982 Japan ..... 346/209

*Primary Examiner*—Bruce H. Hess
*Attorney, Agent, or Firm*—Cushman, Darby & Cushman

[57] ABSTRACT

In a heat-sensitive and heat-transferable recording sheet comprising a substrate, a heat-sensitive, color-forming layer provided on the front side of said substrate and a heat-transferable layer provided on the back side of said substrate, background fogging can be prevented by allowing the heat-transferable layer to be composed essentially of an electron-donating colorless dye, an electron-accepting compound, a low-melting substance and a desensitizer.

10 Claims, 3 Drawing Figures

HEAT-SENSITIVE AND HEAT-TRANSFERABLE RECORDING SHEET

BACKGROUND OF THE INVENTION

(1) FIELD OF THE INVENTION

This invention relates to a heat-sensitive and heat-transferable recording sheet.

(2) DESCRIPTION OF PRIOR ARTS

In recent years, a heat-transferable recording method having advantages such as storability, indelibility and solvent resistance of recorded image has been practically used in parallel with a heat-sensitive recording method employing a heat recording apparatus such as a thermal printer, a thermal facsimile or the like. The heat-transferable recording method uses a heat-transferable recording sheet comprising a subtrate and a heat-meltable ink layer provided thereon. The ink layer side of the heat-transferable recording sheet and a plain paper are superimposed, and the ink of the recording sheet is transferred onto the plain paper by using a heat supplied from a thermal head of a thermal facsimile or the like, whereby recording is conducted. Heat-transferable recording in a single color (e.g. black color) is already in practical use.

There is also a heat-sensitive and heat-transferable recording sheet enabling multiple recording which comprises a substrate, a heat-meltable ink layer (heat-transferable layer) provided on one side of the substrate and a heat-sensitive, color-forming layer provided on the other side of the substrate. In this recording sheet, the heat-transferable layer has a color because the heat-meltable ink used in the layer is a color dye or pigment, and the color is seen through even at the heat-sensitive, color-forming layer side. This is undesirable from the appearance standpoint and makes an image developed on the heat-sensitive, color-forming layer difficult to distinguish clearly. Hence, various improvements have been made for the heat-sensitive and heat-transferable recording sheet.

For example, Japanese patent application Kokai (Laid-open) No. 78793/1983 discloses a thermal recording sheet for multiple recording comprising a substrate, a heat-sensitive, color-forming layer provided on one side of the substrate and a heat-meltable color ink layer provided on the other side of the substrate. However, in order for the color of the heat-meltable ink not to be seen through the substrate at the heat-sensitive, color-forming layer side, the substrate is subjected in advance to vapor deposition of metal.

Further, Japanese patent application Kokai (Laid-open) No. 126482/1980 discloses a heat-sensitive recording sheet for multiple recording comprising a substrate, a heat-sensitive, color-forming layer provided on one side of the substrate and a heat-sensitive, meltable, color-forming, transferable layer containing a combination of a colorless leuco dye and a phenolic compound, provided on the other side of the substrate.

Further, Japanese patent application Kokai (Laid-open) No. 117993/1982 discloses a thermal recording medium comprising a base paper, a heat-sensitive ink layer provided on one side of the base paper and a heat-sensitive, color-forming, transferable layer provided on the other side of the base paper. The heat-sensitive, color-forming, transferable layer is composed of Crystal Violet Lactone, bisphenol A and a wax (e.g. paraffin wax, rice wax).

The recording sheets disclosed in the above laid-open patents each have drawbacks as follows.

In the recording sheet of Japanese patent application Kokai (Laid-open) No. 78793/1983, the substrate need be subjected to metal deposition and it requires one additonal production step and incurs cost increase. Further, since a heat-meltable color ink is used in the heat-transferable layer, there occurs, when the recording sheet and an image-receiving sheet are superimposed for storage, the transfer of the color ink onto the image-receiving sheet and the resulting staining of the image-receiving sheet.

In the recording sheet of Japanese patent application Kokai (Laid-open) No. 126482/1980, a phenolic compound is used for reaction with a leuco dye. The phenolic compounds disclosed therein for said purpose are generally very reactive and easily develop a color in mere mixing with a leuco dye. This causes background fogging of coated surface in the step of coating and drying of a combination of the phenolic compound and the leuco dye.

In the recording sheet of Japanese patent application Kokai (Laid-open) No. 117993/1982, the heat-sensitive, color-forming, transferable layer is composed of Crystal Violet Lactone, bisphenol A and a wax. In coating of these components on a base paper and drying of the resulting layer, there easily occurs background fogging due to the hot air stream used for the drying, making it difficult to obtain a desired white background. Further, since transfer to a plain paper is conducted by using a heat supplied by a thermal head through the base paper to allow the heat-sensitive, color-forming, transferable layer to develop a color, it is necessary for satisfactory transfer to use a large heat amount or to allow the heat-sensitive, color-forming, transferable layer to have a high sensitivity. However, the high sensitivity causes background fogging in the drying step of said layer after coating.

Hence, the first object of the present invention resides in providing a heat-sensitive and heat-transferable recording sheet having a white background, free from the above drawbacks and having no background fogging.

Heat-sensitive and heat-transferable recording sheets are in use in a large amount in recent years because recording can be made simultaneously on said recording sheet and a plain paper by one time recording with a thermal head.

These recording sheets find a major application in chits used in heat recording apparatuses of easily portable type. The recording sheets, however, have a color and this is undesirable from the appearance standpoint and causes pressure fogging or friction smudge. Therefore, a heat-sensitive and heat-transferable recording sheet of a type using a colorless ink has come to be preferably used. There is yet desired a heat-sensitive and heat-transferable recording sheet not only capable of conducting recording with a thermal head but also having such a pressure sensitivity as enables signature by a writing pressure which is necessary when the sheet is used as a chit and the like.

The present inventors had previously invented a heat-sensitive and heat-transferable recording sheet having a pressure sensitivity and had filed a patent application for the recording sheet in Japanese patent application No. 25329/1984. In this record sheet, the whole portion of the colorless, heat-transferable layer has a sensitivity. Therefore, the portions of the heat-transferable layer other than those truly requiring a pressure sensitivity cause friction smudge and moreover such a heat-transferable layer incurs a higher cost. Hence, an improvement is desired.

Therefore, the second object of the present invention resides in providing a heat-sensitive and heat-transferable recording sheet having a pressure sensitivity only at the selected, necessary places which is free from friction smudge and yet is inexpensive and wherein the above mentioned drawbacks caused by a heat-transferable layer whose whole portion has a pressure sensitivity have been improved.

SUMMARY OF THE INVENTION

The present inventors made extensive research in order to achieve the above mentioned first object. As a result, a heat-sensitive and heat-transferable recording sheet having no background fogging could be provided by, in a heat-sensitive and heat-transferable recording sheet comprising a substrate, a heat-sensitive, color-forming layer provided on the front side of the substrate and a heat-transferable layer provided on the back side of the substrate, allowing the heat-transferable layer to be composed of an electron-donating, colorless dye, an electron-accepting compound, a low-melting substance and a desensitizer.

The second object of the present invention could be achieved by providing only on the selected, necessary places of the heat-transferable layer of the above heat-sensitive and heat-transferable recording sheet, a pressure-sensitive ink layer composed essentially of an electron-donating color former, an electron-accepting color developer and a wax, at least either of the color former and the color developer being contained in microcapsules.

DETAILED DESCRIPTION OF THE INVENTION

Figure 1:
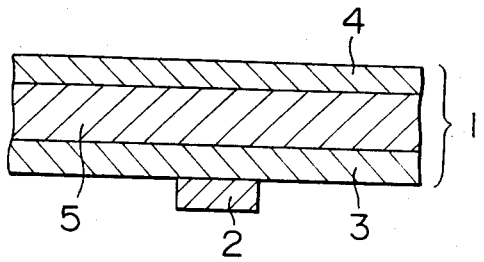
FIGS. 1 and 2 show a fragmentary sectional view and a plan view, respectively, of a heat-sensitive and heat-transferable recording sheet having a pressure sensitivity, as one embodiment of the heat-sensitive and heat-transferable recording sheet of the present invention.

The heat-sensitive and heat-transferable recording sheet for achieving the first object of the present invention, as described above, comprises a heat-transferable layer composed of an electron-donating, colorless dye, an electron-accepting compound, a low-melting substance and a desensitizer. Examples of these components are mentioned below. However, other substances can be used of course as long as they fall under the scope of the present invention.

(1) Desensitizer

The desensitizer used in the present invention is at least one surfactant selected from the group consisting of anionic, cationic, nonionic and ampholytic surfactants. More specifically, the desensitizer is selected from anionic surfactants comprising carboxylic acid salts, sulfonic acid salts and sulfuric acid ester salts; cationic surfactants comprising aliphatic amine salts, quaternary amonium salts of aliphatic amines and aromatic quaternary ammonium salts; nonionic surfactants of ether type, ether ester type and ester type; and ampholytic surfactants comprising betaine derivatives, aminocarboxylic acid salts and imidazoline derivatives.

Desirably, the desensitizer is selected from the following nonionic surfactants.

Ether type nonionic surfactants such as a polyoxyethylene alkyl ether, a polyoxyethylene alkyl ether of a single chain length type, a polyoxyethylene secondary alcohol ether, a polyoxyethylene alkylphenyl ether and the like.

Ether ester type nonionic surfactants such as a polyoxyethylene glycerine - fatty acid ester, a polyoxyethylene castor oil, a polyoxyethylene hardened castor oil, a polyoxyethylene sorbitan - fatty acid ester, a polyoxyethylene sorbitol - fatty acid ester and the like.

Ester type nonionic surfactants such as a polyethylene glycol - fatty acid ester, a fatty acid monoglyceride, sorbitan - fatty acid ester, propylene glycol - fatty acid ester and the like.

The desensitizer is used in the present invention in an amount of preferably 0.05 to 5.0% by weight, more preferably 0.1 to 3.0% by weight based on the total solid content of the heat-transferable layer.

When the desensitizer is used in an amount less than 0.05% by weight, the desensitization effect is small. When it is used in an amount exceeding 5.0% by weight, the effect for the prevention of background fogging remains same, but, when the recording sheet is superimposed on the plain paper and printing is made on the recording sheet with a thermal head, the transferred image formed on a plain paper has no satisfactory density and this density comes down further during storage.

(2) Electron-donating colorless dye

An electron-donating colorless dye generally used in heat-sensitive sheets can be used. It includes, for example, Crystal Violet Lactone, 3-diethylamino-7-methylfluoran, 3-diethylamino-6-chloro-7-methylfluoran, 3-diethylamino-6-methyl-7-chlorofluoran, 3-diethylamino-7-anilinofluoran, 3-diethylamino-7-(2-chloroanilino)fluoran, 3-dibutylamino-7-(2-chloroanilino)fluoran, 3-diethylamino-7-(3-chloroanilino)fluoran, 3-diethylamino-6-methyl-7-anilinofluoran, 3-(N-ethyl-p-toluidino)-6-methyl-7-anilinofluoran, 3-(N-methylcyclohexylamino)-3-methyl-7-anilinofluoran and 3-piperidino-3-methyl-7-anilinofluoran.

(3) Electron-accepting compound (color developer)

An acidic substance generally used in heat-sensitive sheets can be used. It includes, for example, phenol, p-tert-butylphenol, p-phenylphenol, α-naphthol, p-hydroxyacetophenol, 2,2'-dihydroxydiphenol, 4,4'-isopropylidenebis(2-tert-butylphenol), 4,4'-isopropylidenediphenol, 4,4'-cyclohexylidenediphenol, a novolak phenolic resin, benzoic acid, p-tert-butylbenzoic acid, p-oxybenzoic acid, benzyl p-oxybenzoate, methyl p-oxybenzoate, 3-benzyl-4-hydroxybenzoic acid, β-naphthoic acid, salicylic acid, 3-tert-butylsalicylic acid, 3-methyl-5-tert-butylsalicylic acid, stearic acid, oxalic acid and maleic acid.

(4) Low-melting substance

The low-melting substance used in the present invention can be selected from (a) waxes such as paraffin wax, microcrystalline wax, polyethylene wax, beeswax, rice wax, candelilla wax, carnauba wax, montan wax, ozokerite, ceresine, castor wax, opal wax and the like and (2) amides such as stearamide, behenamide, ethylenebisstearamide, methylolstearamide and the like. Preferably, the low-melting substance is used in an amount of 25 to 75% by weight based on the total solid of the heat-transferable layer.

The heat-transferable layer can further contain a binder and a pigment, as necessary.

As the binder, there are mentioned, for example, starch, hydroxyethyl cellulose, methyl cellulose, polyvinyl alcohol, styrene-maleic anhydride copolymer, styrene-butadiene copolymer and polyacrylamide.

As the pigment, there are mentioned, for example, diatomaceous earth, talc, kaolin, calcinated kaolin, calcium carbonate, magnesium carbonate, titanium oxide, silicon oxide, aluminum hydroxide and urea-formalin resin.

The substrate of the heat-sensitive and heat-transferable recording sheet of the present invention is preferred to be thin in view of the required transferability. Accordingly, there can be used papers such as a condenser paper and a glassine paper and resin films made from a polyester, a polyimide, a polycarbonate, a teflon or the like, all having a thickness of 10 to 30 $\mu$m.

Formation of a heat-transferable layer on the other side of the substrate on one side of which a heat-sensitive, color-forming layer has been provided, can be conducted, for example, by coating an aqueous coating color on the whole surface of said side of the substrate using an ordinary coater such as an air knife coater, or by coating an aqueous coating color or a dispersion in a solvent on the whole surface or part of said side of the substrate using a flexographic or gravure printer.

Formation of a heat-sensitive, color-forming layer on one side of the substrate can be conducted by coating a coating color ordinarily used in production of heat-sensitive recording sheets. Therefore, further explanation on this layer is not made.

In the heat-sensitive and heat-transferable recording sheet of the present invention, a heat-sensitive, color-forming layer is provided on the front side of a substrate and a heat-transferable layer is provided on the back side of the substrate. The color development principle of each layer is same and due to reaction between an electron-donating colorless dye and an electron-accepting compound. However, the color development process of each layer is largely different as follows. In the heat-sensitive, color-forming layer, the layer comes in direct contact with a thermal head whereby a color development reaction takes place. In the heat-transferable layer, a heat supplied by the thermal head is transmitted to the layer through the substrate whereby the heat-transferable layer is allowed to develop a color, and subsequently, the color is transferred onto a plain paper. Thus, the heat-transferable layer must achieve the step of color development and the step of color transfer almost simultaneously. This requires a large heat energy or a heat-transferable layer having a very high sensitivity. For obtaining a large heat energy, improvement is needed even in associated apparatuses. A heat-sensitive and heat-transferable recording sheet which does not work well with ordinary thermal printers can not be regarded as a product of wide use.

A heat-transferable layer having a very high sensitivity causes color development even when a small heat energy is applied. Therefore, it is extremely difficult to seek a critical point at which satisfactory transfer takes place but color development does not take place by a small heat energy.

It was found in the present invention that a desensitizer is effective for imparting to the heat-transferable layer satisfactory color developability and transferability without causing background fogging. A low content of a low-melting substance in a coating color for heat-transferable layer causes poor transfer and insufficient color development. A high content of the low melting substance in the coating color improves transferability and color developability as well; consequently, color development takes place, in coating of the coating color, even by a small heat energy causing the background fogging of the heat-transferable layer. Addition of a desensitizer to the coating color can prevent the background fogging.

Thus, use of a desensitizer in the present invention is effective for elimination of background fogging.

Next, explanation will be made on a heat-sensitive and heat-transferable recording sheet having a pressure sensitivity which satisfies the second object of the present invention.

In this recording sheet comprising a substrate, a heat-sensitive, color-forming layer provided on the front side of the substrate and a heat-transferable layer provided on the back side of the substrate, there is provided on the selected places of the heat-transferable layer, a pressure-sensitive ink layer composed essentially of an electron-donating color former, an electron-accepting color developer and a wax, wherein either of the color former and the color developer is contained in microcapsules. This recording sheet having a pressure-sensitive ink layer on the selected places of the heat-transferable layer will be explained below referring to the accompanying drawings.

Figure 2:
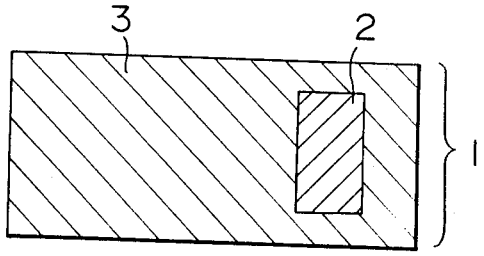
Figure 3:
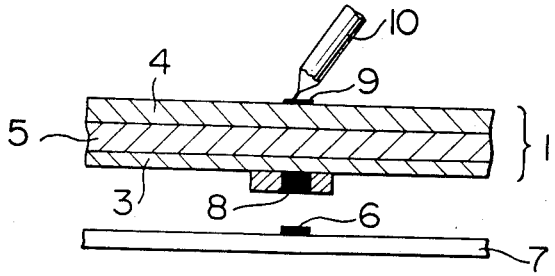
FIG. 3 shows how the recording sheet of FIGS. 1 and 2 is superimposed on an image-receiving sheet and how a writing pressure is applied.

FIGS. 1 to 3 illustrate one example of the structure of the heat-sensitive and heat-transferable recording sheet having a pressure-sensitive ink layer.

FIG. 1 shows a sectional view of a heat-sensitive and heat-transferable recording sheet 1 having a pressure-sensitive ink layer. A heat-sensitive, color-forming layer 4 is provided on one side of a substrate 5; a heat-transferable layer 3 is provided on the other side of the substrate 5; and a pressure-sensitive ink layer 2 is provided on the heat-transferable layer 3.

FIG. 2 shows a plan view of the heat-sensitive and heat-transferable recording sheet 1 having a pressure-sensitive ink layer, taken from the direction of the heat-transferable layer 3. The pressure-sensitive ink layer 2 is provided on the selected place of the heat-transferable layer 3.

FIG. 3 shows a state wherein the heat-sensitive and heat-transferable recording sheet 1 is combined with an image-receiving sheet 7 which is a plain paper. When recording is image on the heat-sensitive color-forming layer 4 with a writing tool 10, a recorded image 9 is formed on the heat-sensitive, color-forming layer 4 and simultaneously the pressure of the writing tool reaches the pressure-sensitive ink layer 2 to destroy the microcapsules in the pressurized portions 8 of the pressure-sensitive ink layer 2, whereby a transferred image 6 is recorded on the image receiving sheet 7.

The pressure-sensitive ink layer 2 is composed essentially of an electron-donating color former, an electron-accepting color developer and a wax, wherein at least either of the color former and the color developer is contained in microcapsules.

The electron-donating color former includes, for example, Crystal Violet Lactone, Malachite Green Lactone, 3-diethylamino-7-methylfluoran, 3-diethylamino-6-methyl-7-chlorofluoran, 3-diethylamino-7-dibenzylaminofluoran, 3-diethylamino-7-anilinofluoran, 3-(N-methylanilino)-7-anilinofluoran, 3-diethylamino-7-

(m-trifluoromethylanilino)fluoran, 3-diethylamino-6-methyl-7-anilinofluoran, 3-(N-methylcyclohexylamino)-6-methyl-7-anilinofluoran, 3-pyrrolidino-6-methyl-7-anilinofluoran, 3-piperidino-6-methyl-7-anilinofluoran, 3-(N-methyl-p-toluidino)-6-methyl-7-anilinofluoran and β-naphtho-spiropyran.

The electron-accepting color developer includes, for example, phenol, p-tert-butylphenol, p-phenylphenol, α-naphthol, β-naphthol, 4,4'-isopropylidenediphenol, 4,4'-sec-butylidenediphenol, 4,4'-isopropylidenebis-(2-tert-butylphenol), 4,4'-cyclophexylidenediphenol, phenyl 4-hydroxybenzoate, a novolak phenolic resin, salicylic acid, 3-phenylsalicylic acid, 5-methylsalicylic acid and 3,5-di-tert-butylsalicylic acid.

The wax includes, for example, paraffin wax, microcrystalline wax, beeswax, spermaceti, shellac wax, carnauba wax, candelilla wax, montan wax, a low molecular polyethylene wax, stearamide, palmitamide, oleamide, lauramide, ethylenebisstearamide, methylenebisstearamide and methylolstearamide.

At least either of the color former and the color developer is contained in microcapsules in the form of a solution dissolved in an non-volatile solvent. As the non-volatile solvent, there can be mentioned, for example, solvents of alkylnaphthalene type, chlorinated paraffin type, diarylethane type, alkyldiphenyl type, aromatic ester type and aliphatic ester type.

The encapsulation of the color former and/or the color developer can be conducted in accordance with any method known in the art such as a complex coacervation method, an in-situ method, an interfacial polymerization method, a spray drying method or the like.

As the stilt for microcapsules, there may be added spherical particles such as wheat starch, a polyolefin or the like; an adhesive such as a polyvinyl alcohol, starch, a sodium salt or ammonium salt of a styrene-maleic anhydride copolymer, a latex of a styrene-butadiene copolymer or the like; or, as necessary, a pigment such as titanium dioxide, calcium carbonate, kaolin, calcinated kaolin, aluminum hydroxide or the like.

Formation of a pressure-sensitive ink layer on the heat-transferable layer can be conducted by partial coating or stripe coating of an aqueous coating color or a coating color dissolved in a solvent with a flexographic printer, a gravure printer, a roll coater or the like.

The present invention will be described more specifically below by way of Examples. Parts in the Examples and the Comparative Examples refer to parts by weight of solid content.

EXAMPLE 1—1

I. A heat-sensitive, color-forming layer of about 5 μm in thickness was formed on one side of a surface-treated polyester film of 16 μm in thickness by coating an ordinary heat-sensitive coating color (for formation of black color) prepared as mentioned in (1) below, with an air knife coater.

(1) Preparation of a heat-sensitive coating color

A dispersion of a dye and a dispersion of a color developer were prepared as follows, respectively.

Fluid A (a dispersion of a dye)

To 332 g of water were added 150 g of 3-diethylamino- 6-methyl-7-anilinofluoran and 18 g of Malon MS-25 (an aqueous solution containing 25% of a sodium salt of a styrene-maleic anhydride copolymer manufactured by Daido Industries Corp.). The mixture was subjected to milling by a ball mill for 48 hours.

Fluid B-1 (a dispersion of a color developer)

To 332 g of water were added 150 g of bisphenol A and 18 g of Malon MS-25. The mixture was subjected to milling by a ball mill for 48 hours.

The fluid A and the fluid B-1 were blended in accordance with the following formulation to prepare a heat-sensitive coating color. Parts refer to parts by weight of solid content.

| | |
|---|---|
| Calcium carbonate PC (manufactured by Shiraishi Kogyo Kaisha, Ltd.) | 5.0 parts |
| Fluid A | 2.0 parts |
| Fluid B-1 | 5.0 parts |
| Stearamide | 2.0 parts |
| Polyvinyl alcohol | 3.45 parts |

II. Then, a coating color for heat-transferable layer prepared as mentioned in (1) below, was coated on the other side of the polyester film with an air knife coater so that the coated amount became 6 g/m$^2$, to form a heat-transferable layer.

(1) Preparation of a coating color for heat-transferable layer

A dispersion of a color developer was prepared as follows.

Fluid B-2 (a dispersion of a color developer)

To 322 g of water were added 150 g of benzyl p-hydroxybenzoate and 18 g of Malon MS-25. The mixture was subjected to milling by a ball mill for 48 hours.

The fluid A (the dye dispersion used in the heat-sensitive coating color) prepared in I(1), the above fluid B-2 (the dispersion of a color developer), a paraffin wax having a melting point of 65° C., stearamide having a melting point of 95° C. and a straight chain primary alcohol ethoxylate as a nonionic surfactant 8 Adekatol LO-15 (brand name) manufactured by ASAHI DENKA KOGYO K.K.] were blended according to the following formulation to obtain a coating color for heat-transferable layer.

| | |
|---|---|
| Fluid A | 5 parts |
| Fluid B-2 | 25 parts |
| Paraffin wax | 40 parts |
| Stearamide | 30 parts |
| Nonionic surfactant | 0.04 part |

(Parts refer to parts by weight of solid content.)

III. For the heat-sensitive and heat-transferable recording sheet obtained above, the reflection density of the background of the heat-transferable layer was measured using a Macbeth densitometer (RD-918 model). Then, the heat-transferable layer of the recording sheet was superimposed on a plain paper [an image-receiving sheet for heat-transferable sheet, TTR-PW (brand name), manufactured by Mitsubishi Paper Mills Ltd.], and printing was made from the heat-sensitive, color-forming layer side using a facsimile tester manufactured by Matsushita Electronic Components Co., Ltd. and a pulse width of 3.0 msec (2.22 mJ). Also, the density of printed image was measured using the Macbeth densitometer. The results are shown in Table 1.

EXAMPLE 1-2

The procedure of Example 1—1 was repeated except that the amount of the nonionic surfactant used in Example 1—1 was changed to 0.3 part. The results are shown in Table 1.

EXAMPLE 1-3

The procedure of Example 1—1 was repeated except that the amount of the nonionic surfactant used in Example 1—1 was changed to 6.0 parts. The results are shown in Table 1.

COMPARATIVE EXAMPLE 1

The procedure of Example 1—1 was repeated except that no surfactant was used. The results are shown in Table 1.

TABLE 1

| | Amount of surfactant added, parts | Density of background of heat-transferable layer | Density of printed image on plain paper |
|---|---|---|---|
| Example 1-1 | 0.04 | 0.30 | 1.12 |
| Example 1-2 | 0.3 | 0.09 | 1.06 |
| Example 1-3 | 6.0 | 0.08 | 0.77 |
| Comparative Example 1 | 0 | 0.55 | 1.10 |

As is obvious from Table 1, when the amount of the surfactant is 0.3 part, the background of heat-transferable layer is white and the density of printed image on plain paper is high. When the surfactant amount is 0.04 part, although the density of printed image is high, background fogging is seen but is less than the case using no surfactant. When the surfactant amount is 6.0 parts, there is no background fogging.

EXAMPLE 2-1 to 2-5

As a color developer dispersion for a coating color for heat-transferable layer, the fluid B-1 (containing bisphenol A) used in the heat-sensitive coating color of Example 1—1 was used in place of the fluid B-2 (containing benzyl p-hydroxybenzoate) used in the coating color for heat-transferable layer of Example 1—1. Using this fluid B-1 and the fluid A of Example 1—1, a coating color for heat-transferable layer was prepared in accordance with the following formulation. In the formulation, a polyvinyl alcohol was used as a binder and a polyoxyoleyl ether [Emulgen 420 (brand name) manufactured by Kao Corp.] was used as a nonionic surfactant.

| | |
|---|---|
| Fluid A | 8 parts |
| Fluid B-1 | 30 parts |
| Paraffin wax (m.p.: 65° C.) | 32 parts |
| Stearamide (m.p.: 95° C.) | 20 parts |
| Polyvinyl alcohol | 10 parts |
| Nonionic surfactant | |
| Example 2-1 | 0.04 part |
| Example 2-2 | 0.06 part |
| Example 2-3 | 0.5 part |
| Example 2-4 | 4.0 parts |
| Example 2-5 | 6.0 parts |

(Parts refer to parts by weight.)

The subsequent procedure was same as that in Example 1—1 to produce each heat-sensitive and heat-transferable recording sheet of Examples 2-1 to 2-5. These recording sheets were subjected to the same measurements as in Example 1—1.

The results are shown in Table 2.

COMPARATIVE EXAMPLE 2

A heat-sensitive and heat-transferable recording sheet was produced in the same procedure as in Example 2-1 except that no surfactant was used. The recording sheet was subjected to the same measurements as in Example 2-1.

The results are shown in Table 2.

TABLE 2

| | Amount of surfactant added, parts | Density of background of heat-transferable layer | Density of printed image on plain paper |
|---|---|---|---|
| Example 2-1 | 0.04 | 0.23 | 1.13 |
| Example 2-2 | 0.06 | 0.20 | 1.12 |
| Example 2-3 | 0.5 | 0.10 | 1.11 |
| Example 2-4 | 4.0 | 0.09 | 0.89 |
| Example 2-5 | 6.0 | 0.07 | 0.79 |
| Comparative Example 2 | 0 | 0.62 | 1.15 |

EXAMPLES 3 to 6, COMPARATIVE EXAMPLES 3 to 4

Experiments were conducted in the same manner as in Example 1—1 except that the type and amount of nonionic surfactant used in Example 1—1 were changed. The results are shown in Table 3.

TABLE 3

| | Surfactant | | | | Density of background of heat-transferable layer | Density of printed image on plain paper |
|---|---|---|---|---|---|---|
| | Type | Chemical description | Brand name | Amount added, parts | | |
| Example 3 | Nonionic | Polyoxyethylene sorbitan trioleate | Tween 85 | 0.04 | 0.25 | 1.11 |
| | | | | 0.06 | 0.19 | 1.09 |
| | | | | 1.50 | 0.15 | 1.06 |
| | | | | 5.0 | 0.08 | 1.04 |
| | | | | 6.0 | 0.05 | 0.96 |
| Comparative Example 3 | | | | 0 | 0.64 | 1.15 |
| Example 4 | Anionic | Dialkyl sulfo-succinate | Pelex OT-P | 0.04 | 0.22 | 1.14 |
| | | | | 0.06 | 0.18 | 1.13 |
| | | | | 0.8 | 0.11 | 1.10 |
| | | | | 4.0 | 0.08 | 0.93 |
| Comparative Example 4 | | | | 0 | 0.06 | 0.88 |
| Example 5 | Cationic | Laurylamine acetate | Acetamin 24 | 0.04 | 0.24 | 1.15 |
| | | | | 0.06 | 0.20 | 1.14 |
| | | | | 1.0 | 0.10 | 1.10 |
| | | | | 4.0 | 0.08 | 1.09 |
| | | | | 6.0 | 0.07 | 0.96 |
| Example 6 | Ampholytic | Stearyl betaine | Anhitol 86B | 0.04 | 0.21 | 1.11 |

TABLE 3-continued

| Surfactant | | | | Density of background of heat-transferable layer | Density of printed image on plain paper |
|---|---|---|---|---|---|
| Type | Chemical description | Brand name | Amount added, parts | | |
| | | | 0.06 | 0.16 | 1.09 |
| | | | 2.0 | 0.09 | 1.05 |
| | | | 4.0 | 0.06 | 0.91 |
| | | | 6.0 | 0.05 | 0.87 |

EXAMPLES 7-1 to 7-3, COMPARATIVE EXAMPLES 4 to 6

The same heat-sensitive, color-forming layer as used in Example 1—1 was provided on one side of a surface-treated polyester film of 16 μm in thickness in the same manner as in Example 1—1. Then, a coating color for heat-transferable layer having the following formulation was coated on the other side of the polyester film to prepare a heat-transferable layer.

In the formulation, the fluid A and the fluid B-2 both used in Example 1—1 were used as a dye dispersion and a color developer dispersion, respectively. A paraffin wax having a m.p. of 65° C. and stearamide having a m.p. of 95° C. were used as low-melting substances. A straight chain primary alcohol ethoxylate [Adekatol LO-15 (brand name) manufactured by ASAHI DENKA KOGYO K.K.] was used as a nonionic surfactant Calcium carbonate [Calcium Carbonate PC (brand name) manufactured by Shiraishi Kogyo Kaisha, Ltd.] was used as a pigment. A polyvinyl alcohol was used as a binder. The amounts of each component are shown in Table 4.

TABLE 4

| | Fluid A, parts | Fluid B-2, parts | Calcium carbonate, parts | Paraffin wax, parts | Stearamide, | Polyvinyl alcohol, parts | Nonionic surfactants, parts |
|---|---|---|---|---|---|---|---|
| Example 7-1 | 2 | 10 | 10 | 15 | 10 | 52 | 1 |
| Example 7-2 | 2 | 10 | 10 | 30 | 20 | 27 | 1 |
| Example 7-3 | 2 | 10 | 10 | 50 | 25 | 2 | 1 |
| Comparative Example 4 | 2 | 10 | 10 | 10 | 10 | 57 | 1 |
| Comparative Example 5 | 2 | 10 | 0 | 50 | 30 | 7 | 1 |
| Comparative Example 6 | 2 | 10 | 10 | 0 | 0 | 77 | 1 |

(Parts refer to parts by weight of solid content.)

The reflection density of the background of the heat-transferable layer as well as the density of the printed image formed on a plain paper were measured in the same manners as in Example 1—1. The results are shown in Table 5.

TABLE 5

| | Density of background of heat-transferable layer | Density of printed image on plain paper |
|---|---|---|
| Example 7-1 | 0.07 | 1.01 |
| Example 7-2 | 0.07 | 1.10 |
| Example 7-3 | 0.06 | 1.05 |
| Comparative Example 4 | 0.28 | 0.45 |
| Comparative Example 5 | 0.10 | 0.66 |
| Comparative Example 6 | 0.69 | 0.78 |

As is obvious from Table 5, the background density is low and the density of printed image is high in Examples 7-1 to 7-3: Meanwhile, in Comparative Examples 4 and 5, transfer is difficult and accordingly the printed image density is low. In Comparative Example 6, the background density is high and background fogging is seen.

EXAMPLE 8

There was prepared a heat-sensitive and heat-transferable recording sheet comprising a polyester film of 16 82 m in thickness, a heat-sensitive, color-forming layer provided on one side of the polyester film and a heat-transferable layer provided on the other side of the polyester film. On the selected places of the heat-transferable layer of the recording sheet was coated a pressure sensitive ink having the following formulation.

| | |
|---|---|
| Microcapsules containing a color former (3-diethylamino-6-methyl-7-phenylaminofluoran) (for black color formation) | 10 parts by weight |
| Microcapsules containing a color developer (p-phenylphenol) | 20 parts by weight |
| Stearamide | 30 parts |
| SBR latex | 30 parts |
| Wheat starch | 10 parts |

This ink was coated in the form of a 40% aqueous dispersion on the selected places of the heat-transferable layer using a flexographic printer to prepare a heat-sensitive and heat-transferable recording sheet with a pressure sensitivity having a white background.

This recording sheet was superimposed on an image-receiving sheet [TTR-PW (brand name) manufactured by Mitsubishi Paper Mills Ltd.] so that the pressure sensitive ink layer side of the recording sheet came in contact with the image-receiving sheet. A writing pressure was applied to them at the heat-sensitive, color-forming layer side of the recording sheet to obtain a clear, black printed image on the image-receiving sheet. Separately, thermal recording was conducted to them at the portions of the recording sheet other than the pressure-sensitive ink layer using a thermal head, whereby a thermally recorded image was obtained on the recording sheet and a thermally transferred recorded image was obtained on the image-receiving sheet.

As described in detail above, the present invention can provide a heat-sensitive and heat-transferable recording sheet which is free from the background fogging of heat-transferable layer as a result of the combination use of a low-melting substance and a desensitizer and accordingly has a high sensitivity and does not adversely affect the density of the printed image transferred onto a plain paper. This recording sheet excels also in handling and appearance compared with conventional heat-sensitive and heat-transferable recording sheets using a heat-meltable color ink.

The present invention can further provide a heat-sensitive and heat-transferable recording sheet having a pressure sensitivity which is free from friction smudge and yet is inexpensive.

What is claimed is:

1. A heat-sensitive and heat transferable recording sheet comprising a substrate, a heat-sensitive, color-forming layer provided on the front side of said substrate and a heat-transferable layer provided on the back side of said substrate, wherein the heat-transferable layer is composed essentially of an electron-donating colorless dye, an electon-accepting compound, a low-melting substance and a desensitizer which is a surfactant selected from the group consisting of anionic surfactants, cationic surfactants, nonionic surfactants and ampholytic surfactants, the amount of desensitizer being 0.05 to 5% by weight based on the total solid of the heat-transferable layer, the amount of the low-melting substance being 25% to 75% by weight based on the total solid of the heat-transferable layer.

2. A heat-sensitive and heat-transferable recording sheet according to claim 1, wherein the amount of the desensitizer is 0.1 to 3.0% by weight based on the total solid of the heat-transferable layer.

3. A heat-sensitive and heat-transferable recording sheet according to claim 1, wherein the desensitizer is at least one surfactant selected from the group consisting of ether type, ether ester type and ester type nonionic surfactants.

4. A heat-sensitive and heat-transferable recording sheet according to claim 3, wherein the surfactant is an ether type nonionic surfactant and is selected from the group consisting of a polyoxyethylene alkyl ether, a polyoxyethylene secondary alcohol ether and a polyoxyethylene alkylphenol ether.

5. A heat-sensitive and heat-transferable recording sheet according to claim 3, wherein the surfactant is an ether ester type nonionic surfactant and is selected from the group consisting of a polyoxyethylene glycerine - fatty acid ester, a polyoxyethylene castor oil, a polyoxyethylene hardened castor oil, a polyoxyethylene sorbitan - fatty acid ester and a polyoxyethylene sorbitol - fatty acid ester.

6. A heat-sensitive and heat-transferable recording sheet according to claim 3, wherein the surfactant is an ester type nonionic surfactant and is selected from the group consisting of a polyethylene glycol - fatty acid ester, a fatty acid - monoglyceride, sorbitan - fatty acid ester and propylene glycol - fatty acid ester.

7. A heat-sensitive and heat-transferable recording sheet according to claim 1, wherein the low melting substance is at least one member selected from the group consisting of waxes and amides.

8. A heat-sensitive and heat-transferable recording sheet according to claim 7, wherein the low-melting substance is a wax selected from the group consisting of paraffin wax, microcrystalline wax, polyethylene wax, beeswax, rice wax, candelilla wax, carnauba wax, montan wax, ozokerite, ceresine, castor wax, and opal wax.

9. A heat-sensitive and heat-transferabale recording sheet according to claim 7, wherein the low-melting substance is an amide selected from the group consisting of stearamide, behenamide, ethylene-bis-stearamide, methylolstearamide and oleamide.

10. A heat-sensitive and heat-transferable recording sheet comprising a substrate, a heat-sensitive, color-forming layer provided on the front side of said substrate and a heat-transferable layer provided on the back side of said substrate, wherein the heat-transferable layer is composed essentially of an electron-donating colorless dye, an electron-accepting compound, a low-melting substance and a desensitizer, there being provided a pressure-sensitive ink layer on selected necessary places of the heat-transferable layer, the ink layer being composed essentially of an electron donating color former, an electron-accepting color developer and a wax and at least either of the color former and the color developer being contained in microcapsules.

* * * * *